United States Patent [19]

Ye

[11] Patent Number: 4,722,208

[45] Date of Patent: Feb. 2, 1988

[54] COMBINATION LOCK FOR SUITCASES, LUGGAGE AND THE LIKE

[76] Inventor: Chean-Chen Ye, No. 139, Sec. 2, Chang Hsing Road, Ho Mei City, Changhua, Taiwan

[21] Appl. No.: 940,217

[22] Filed: Dec. 8, 1986

Related U.S. Application Data

[63] Continuation-in-part of Ser. No. 817,693, Jan. 9, 1986, abandoned.

[51] Int. Cl.[4] ..... E05B 37/02

[52] U.S. Cl. ..... 70/312; 70/316

[58] Field of Search ..... 70/67, 69–76, 70/312, 315–318

[56] References Cited

U.S. PATENT DOCUMENTS

| | | | |
|---|---|---|---|
| 4,327,566 | 5/1982 | Ling | 70/312 |
| 4,343,164 | 8/1982 | Bako | 70/312 |
| 4,343,165 | 8/1982 | Bako | 70/312 |
| 4,348,878 | 9/1982 | Chang | 70/312 |
| 4,383,425 | 5/1983 | Orabona | 70/312 |
| 4,441,346 | 4/1984 | Castiglioni | 70/312 |
| 4,487,043 | 12/1984 | Milles | 70/312 |
| 4,503,691 | 3/1985 | Li | 70/312 |
| 4,520,641 | 6/1985 | Bako | 70/312 |
| 4,532,784 | 8/1985 | Yeh | 70/312 |
| 4,554,809 | 11/1985 | Yang | 70/312 |

*Primary Examiner*—Robert L. Wolfe

*Attorney, Agent, or Firm*—Townsend & Townsend

[57] ABSTRACT

A combination lock for suitcases, luggage and the like of a simplified construction has a knob with three positions: a locking position, an unlocking position and a third position for changing the combination code of the lock. In order to prevent undesired entry into the code-changing position, a blocking mechanism is provided which is conveniently mounted on the knob. Normally the blocking mechanism can prevent the knob from entering its code-changing position, and during the re-adjustment of the code, the blocking mechanism can retain the knob in its code changing position. The lock is further provided with a latch member which allows a corresponding flap or hook to be pressed into locking position regardless of whether or not the number wheels are correctly dialed.

3 Claims, 33 Drawing Figures

COMBINATION LOCK FOR SUITCASES, LUGGAGE AND THE LIKE

This is a continuation-in-part of application Ser. No. 817,693, filed Jan. 9, 1986, now abandoned.

BACKGROUND OF THE INVENTION

This invention relates to an improved mechanism for the combination lock of suitcases, luggages or the like.

The characteristic features of this invention consists in two aspects. Firstly, it is free of the risk of undesired alteration of the code. Secondly, the eyelet of the latch flap can still be pressed into the hole of the lock even when the latter is not adjusted to the correct code.

Currently available combination locks for suitcases with changeable code suffer two disadvantages. Structurally, all such locks have a spring-loaded shifting shaft which is directly in mechanical connection with the actuating knob and directly actuated by the latter to shift between a locking position and an unlocking position. A plurality of (practically three) number wheels are mounted on the lock and centrally passed through by the shifting shaft. Please refer to FIG. 14A. Corresponding to the number wheels (12'), the shifting shaft (6) carries a plurality of wards. Each number wheel (12'), corresponding to a ward (a), is provided with a notch. When all number wheels are adjusted to the correct code so that their notches (b) are in alignment with the corresponding wards, the shifting shaft is permitted to shift to the open position. Otherwise the shifting shaft is hindered by the number wheels which are not correctly dialed. FIG. 14A illustrates an example of unchangeable code. In the case of changeable code (please refere to FIG. 14B), the ward is carried on an inner wheel (c) which is rotatably but not axially slidably mounted on the shaft. When it is desired to change the code, one must first set the lock in the correct code and keep the knob in the "open" position so as to retain the shifting shaft in the unlocking position. Now all the wards of the inner wheels are in engagement with the number wheel so that an inner wheel can be driven to rotate together with its corresponding number wheel to a new position, therefore renewing the code. The inner wheel is not necessarily provided with a ward. Alternatively it can be provided with a notch or slot. In this case, a corresponding ward or projection can be provided on the housing or wheel retainer. FIG. 14C and FIG. 14D (The fragmentary view of FIG. 14C) illustrate a preferred example. The inner wheel (14') has the shape of a gear with teeth (d), but a tooth is lacking, thus forming a bigger interdental space (e). The interdental space thus serves as an equivalent of a notch. A projection (f) is provided in the route of the inner wheel. When correctly dialed, the inner wheel has its notch (e) in alignment with the projection (g). This invention relates to the improvement on this type.

The conventional combination lock typically has a complicated construction. Further, the conventional combination lock is subject to the risk of having the code unintentionally altered if the wheels are disturbed during unlocking operation. Moreover, in order to press the latch flap into the locking position, the conventional combination lock suffers the disadvantage that is must first be set to the proper code.

Accordingly it is the main object of this invention to provide a combination lock of simplified construction and use which is free of the risk of undesired alteration of the code.

It is another object of this invention to ensure the code-changing position not to be entered unless desired, thus totally eliminating the risk of undesired alteration of the code by any possible undue operation, and to provide a securing means to retain the knob in code-changing position so that one can change the code without using an extra hand to keep the knob in this position.

It is the third object of this invention to provide a combination lock, which allows the flap to be pressed into its locking position regardless of whether or not the lock is correctly adjusted to its correct code.

The first object is achieved by a shifting shaft having three positions instead of two in conventional locks: a locking position, an unlocking position and a code-changing position. Only in the code-changing position can the code be changed. The middle position is the locking position, while the two end positions are respectively unlocking position and code-changing position. The middle, locking position is the balance position of the spring-loaded shifting shaft. In both end positions, the spring is compressed and when no external force is applied, the shifting shaft will resiliently return to the middle position. The three-position-mechanism can be applied to various devices of code-changing mechanism, but here we only discuss the case of FIG. 14C. When a suitcase provided with such lock is desired to open, dial the number wheels to the correct code, then shift the knob to the unlocking position. In so doing the suitcase is opened. This operation is exactly the same as with a conventional lock. On the other hand, when it is desired to change the code, set the number wheels to the correct number and then shift the knob to the code-changing position, and then dial the number wheels to the desired new number. Thus, when the inner wheels return resiliently to the middle position where they re-engage with the number wheels, the code is changed to the new number.

Even if the number wheels are not unintentionally altered while unlocking the suitcase, there are still minor possibilities of undesired change of code by undue operation, though the probability is very small. A user may inadvertently shift the knob to code-changing position instead of to the unlocking position even when it is not desired to change the code. To prevent entry to the code-changing position, one can easily use a small piece of plastic, wood, or other stiff material which blocks the way of the knob from the locking position to the code-changing position. But such a blocking piece causes unslightly appearance of the lock, and it is liable to fall out from its blocking position. Accordingly, the second object of this invention is to provide a blocking mechanism which hinders the entry into the code-changing position. When it is desired to change the code, the knob must be released from the blocking mechanism to make possible its entry into code-changing position. Practically, the blocking mechanism is provided directly on the knob, and can be shifted up and down along the surface of knob between two positions, namely blocking and unblocking positions, in a direction perpendicular to the shifting of the knob. Preferably, the knob is divided into two parts, a knob frame, and a blocking switch, which makes the blocking mechanism. Preferably the blocking switch is retained in either of the blocking or the unblocking position rather than resiliently biased toward one of the two positions. In whichever position, the blocking switch is carried by the knob frame to shift among the locking, unlocking, and code-changing positions as an entity. When the blocking switch is normally in its blocking position, it will be blocked by a projection housing of the lock, so the knob cannot be pushed to its code-changing position. When the blocking switch is switched over to its unblocking position, it is no longer blocked by the housing, and the knob can now be shifted to its unlocking position.

When the knob reaches its code changing position, if the user pushes the blocking switch back to its blocking position, the projection, which previously blocked the way to the code-changing position, will now block the way returning to the locking position. Therefore the knob can be secured in code-changing position without applying an extra external force. When the new code has been readjusted, push the blocking switch up its unblocking position, and the knob will resiliently resume its locking position. Now the code has been changed, and the blocking switch can be switched back to its normal blocking position.

The third object is achieved by a latch member which is not fixedly mounted on one end of the shifting shaft. In conventional combination locks, the latch member for locking the latch member is generally fixed on one end of the shifting shaft or forms as an integral part of the latter. For this reason, the latch member must move synchronously with the shifting shaft. If the code is not correctly adjusted, the shifting shaft is hindered by the number wheels and cannot move. Hence the latch member cannot move, and the latch flap cannot be pressed into locking position. In the present invention, the latch member is not fixed, but resiliently supported and retained at one end of the shifting shaft, and therefore can be axially pressed a small distance toward the opposite end of the shaft. Thus even if the number wheels are not in correct position and the shifting shaft cannot move, when the latch flap is swung down and its eyelet is pressed into the latch hole, the latch member is pushed aside by the eyelet of the latch flap and then resiliently engages with the eyelet.

This invention will be better understood when read in connection with the accompanying figures. In order to help the reader to understand the orientation of the elements, X, Y, Z coordinates have been shown in some of the figures to indicate respectively the width, height and depth orientation of the lock.

BRIEF DESCRIPTION OF THE DRAWING

FIGS. 14A to 14D are examples of various conventional mechanisms for combination lock, wherein FIG. 14D is a fragmentary view of FIG. 14D.

DETAILED DESCRIPTION OF PREFERRED EMBODIMENT

Figure 1:
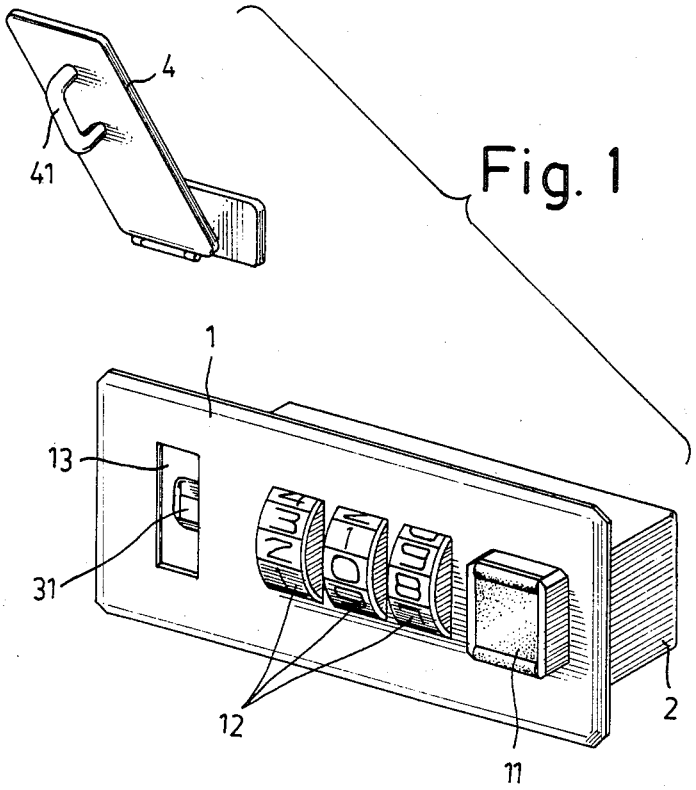
FIG. 1 is a perspective view of the present invention showing the front side of the lock.
Figure 2:
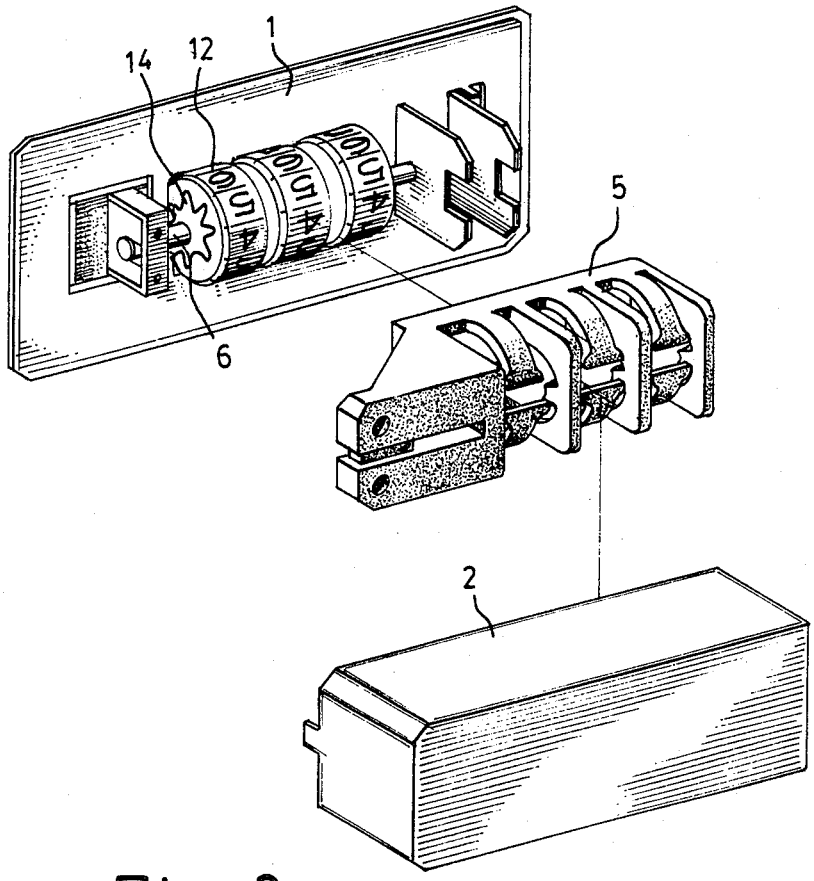
FIG. 2 is a perspective view of the present invention, showing the rear side of the lock with the housing and wheel retainer removed to reveal the internal structure.

With reference to the drawing, FIG. 1 shows a lock according to this invention. Externally like most of the conventional combination locks of its kind, it comprises an escutcheon or cover plate (1) on which there are provided an actuating knob (11), a plurality of (typically three) number wheels (12) and a latch hole (13), and a housing (2). Through the latch (13) one can see a portion of the latch member (31) which can engage with an eyelet (41) provided on one side of a latch flap (4) mounted on the cover of a suitcase (not shown). In FIG. 2, one can see a wheel retainer (5) made of plastic material. Like the wheel retainers of conventional combination lock, it serves only to retain the number wheel in fixed axial position to avoid the dislocation thereof, and to provide the necessary projections to block the way of inner wheels. The number wheel is structurally and functionally similar to the known type in FIG. 14C, with a slight difference which will be described later.

Figure 3A:
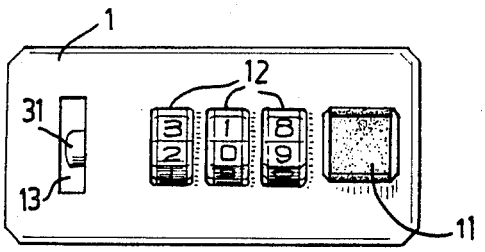
FIGS. 3A to 3C are the front views of the lock respectively showing the locking, unlocking and code-changing position of the knob.
Figure 3B:
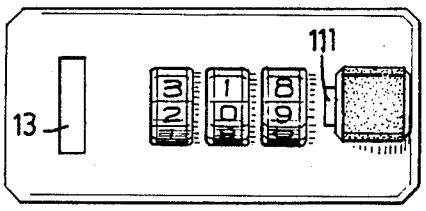
Figure 3C:
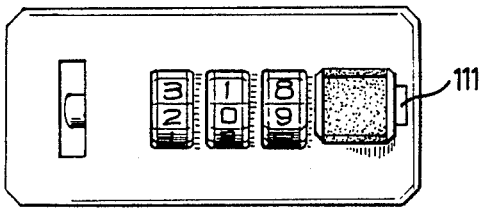

FIGS. 3A to 3C respectively illustrate the three positions of the actuating knob in use, namely locking position, unlocking position, and code changing position. In FIG. 3A, the knob (11) is in its middle position (locking position). The latch member (31) can be seen in the latch hole (13). When the latch flap is swung down, its eyelets (41) will be engaged with the latch member. When locking is desired, the number wheels must be set in correct code at first, then pull the knob to the position in FIG. 3B, so the latch member is retracted from the latch hole, thus releasing the eyelet (41). On the other hand, when it is desired to change the code, pull the knob (11) to the position in FIG. 3C, then keep the knob in this position and adjust the number wheels to the desired new code. Then release the knob (11) to let it resume elastically to the position in FIG. 3A. In so doing, the code is changed. Of course, when one desires to change the code, the number wheels must at first be adjusted to the previous correct code, so that the knob can be shifted in the X2 direction. In the positions of 3A and 3B, the code cannot be changed, while in the position of 3C the code can be changed. The knob is guided in a guiding slot (111) of the cover plate (1). The guiding slot (111) is seen in FIGS. 3B and 3C.

Figure 4A:
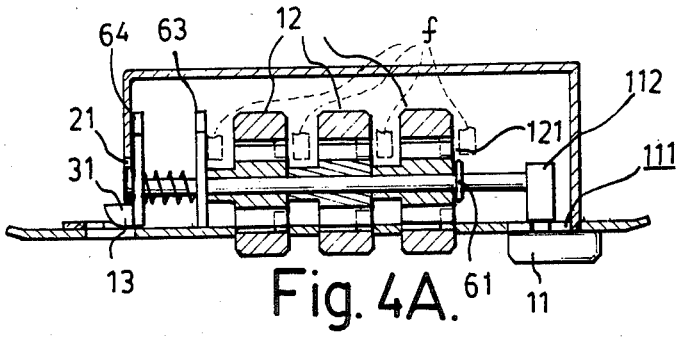
FIGS. 4A to 4C are the top sectional views of the lock corresponding to FIGS. 3A to 3C.
Figure 4B:
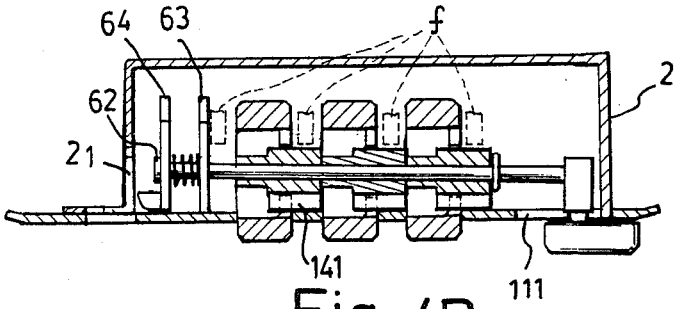
Figure 4C:
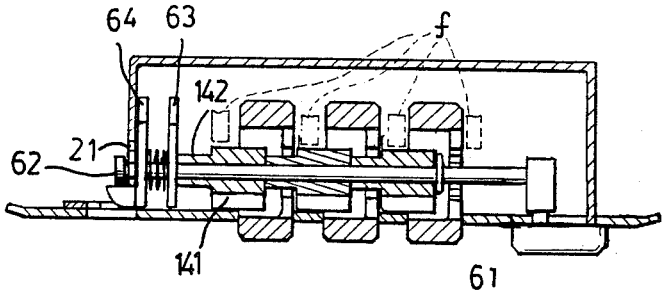
Figure 5A:
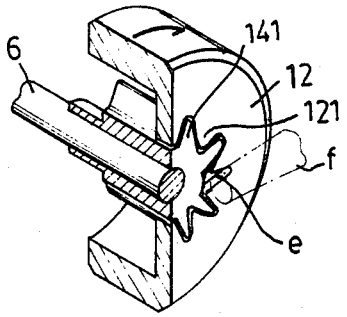
FIGS. 5A to 5C are the perspective partial sectional views showing the three states of an inner wheel in a number wheel.
Figure 5B:
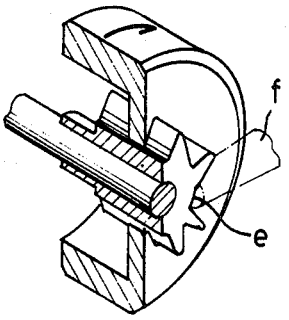
Figure 5C:
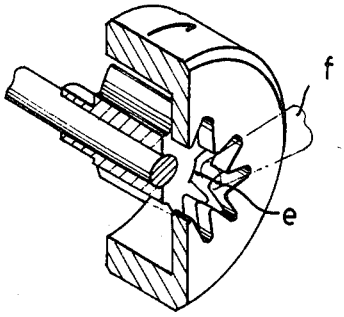
Figure 6:
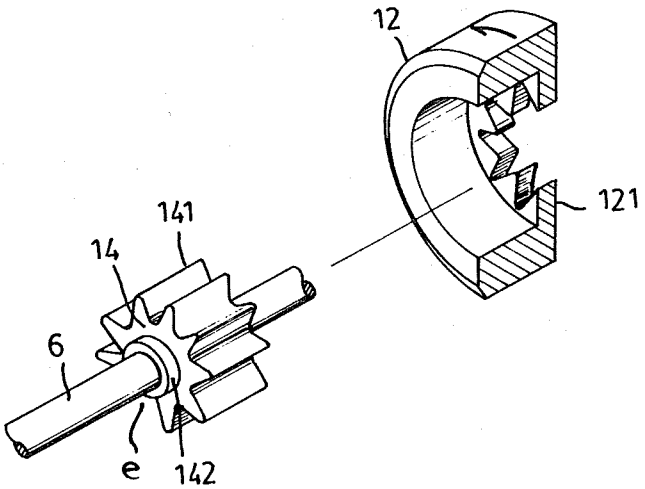
FIG. 6 is a perspective view showing the inner and number wheel.
Figure 14A:
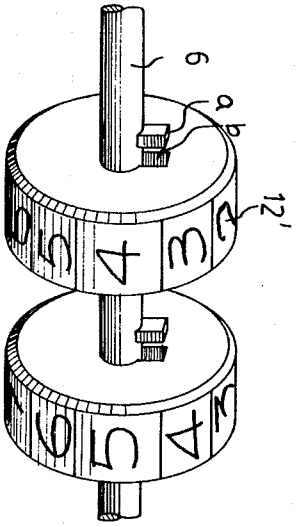
PRIOR ART Fig. 14A
Figure 14B:
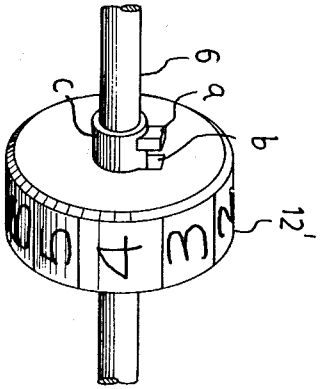
PRIOR ART Fig. 14B
Figure 14C:
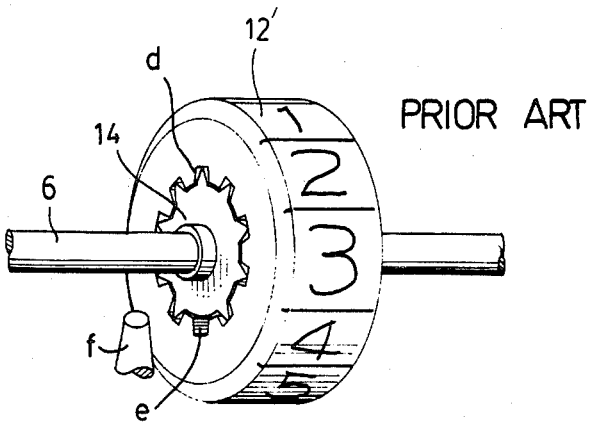
Fig. 14C. PRIOR ART
Figure 14D:
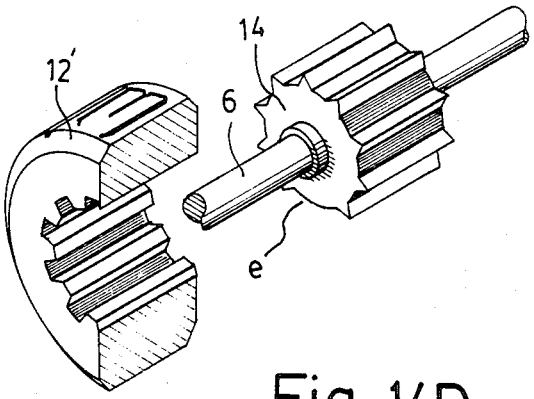

FIGS. 4A to 4C and FIGS. 5A to 5C show the three positions corresponding respectively to FIGS. 3A to 3C. From here one can understand why the code can only be changed in FIG. 3C and not in FIGS. 3A and 3B. This fact is more clearly illustrated in FIG. 6 and FIGS. 5A to 5C. The number wheel (12) differs from the number wheel (12') in FIG. 14C. In the device of FIG. 14C, the inner recess of the number wheel (12')

forms an inner gear. (though the device of number wheel of this invention can also be used in the case of FIG. 14C.) The number wheel (12) is only provided with inwardly projecting teeth (121) at one end. The inner wheel (14) is exactly the same as the inner wheel (14') in FIG. 14C, and is provided with nine teeth (141) leaving a greater interdental space (e). In both locking position and unlocking position, the teeth (141) of inner wheel and the teeth of number wheel (121) are in engagement (see FIGS. 4A, 4B, and 5A, 5B), thus the inner wheel (14) always corrotates with the number wheel (12) and its notch (e) always corresponds to the same number on the number wheel (12), so the code will not be changed. In code changing position (see FIGS. 4C and 5C), the inner wheel (14) is disengaged from the number wheel (12), so the rotation of a number wheel (12) becomes "free rotation". In other words, its rotation does not cause the simultaneous rotation of the inner wheel (14). Thus the notch (e) will correspond to a new number when the number wheel is turned to a new position. In FIG. 4A and FIG. 5A, one can see that if the number wheel is correctly dialed, the notch (e) will be aligned with the projection (f) (expressed in broken line), thus permitting the knob to be pulled to the unlocking position or the code-changing position. Practically, the projection (f) extends from the wheel retainer (5). Since it is known in the conventional lock of FIG. 14C, detailed description is not necessary. The wheel retainer (5) is placed between housing (2) and number wheels (12). In FIGS. 4A to 4C, the wheel retainer is not shown for the purpose of simplicity.

Now the reader has known the engagement and disengagement of the inner wheel (14) and the number wheel (12). Now we will explain how the three-position function is obtained.

Figure 7A:
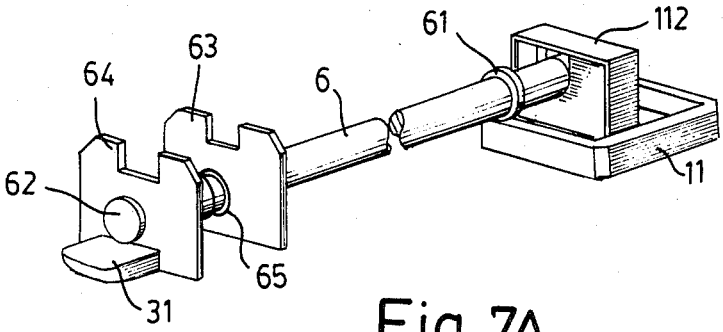
FIGS. 7A and 7B illustrate the two spring-loaded sheets mounted on the shifting shaft, with all the wheels removed.
Figure 7B:
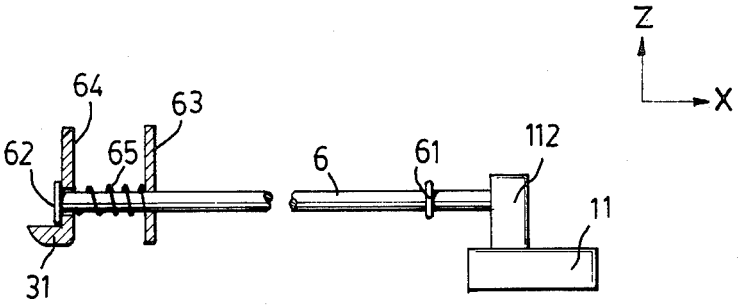

Referring now to FIGS. 7A and 7B. The shifting shaft (6) has one end fixed to a knob base (112) of the knob (11), therefore it can be shifted axially in the X-axis direction with the knob (11). The free end of shifting shaft (6) forms a flange (62). There is another flange (61) near its fixed end. Two pressing sheets (63), (64) are provided with a hole through which they are penetrated by the shifting shaft. Note the two sheets (63) (64) are only slidably supported, but not fixed, on shaft (6). A compression spring (65) is loaded between them. The flange (62) can retain the pressing sheet (64) on the shifting shaft (6). Latch member (31) is fixed at the lower part of pressing sheet (64). Referring to FIG. 4A, when the inner wheels are mounted on shifting shaft (6), the pressing sheet (63) will resiliently urge the inner wheels toward the flange (61). The inner wheels are pressed to lean together in a head-to-tail manner. Consequently the inner wheel are only allowed to rotate around shifting shaft (6), but not allowed to slide axially thereon. The locking position in FIG. 4A is the balanced position of this resilient mechanism. When the knob (11) is shifted to the unlocking position, pressing sheet (63) is stopped by the outer wheel (12) and the corresponding portion of wheel retainer, it cannot make so much axial shift as the shifting shaft (6). But pressing sheet (64) is forced by the flange (62) to move as far a distance as the shifting shaft (6). Accordingly, the spring (65) is compressed, thus producing a resumptive force which forces the knob (11) to return to its unlocking position. Likewise, when the knob (11) is shifted to the code-changing position as in FIG. 4C, the flanged free end of the shaft (6) can pass through a slot (21) on the housing (2), but the pressing sheet is stopped by the housing (6) (see FIG. 3), and cannot make as much axial shift as the shaft (6). On the other hand, sheet (63) is forced by the hub (142) of inner wheel to shift as long as distance as does the shaft (6). As a result, the spring (65) is compressed, thus producing a resumptive force which forces the knob (11) to return to its locking position.

Figure 8A:
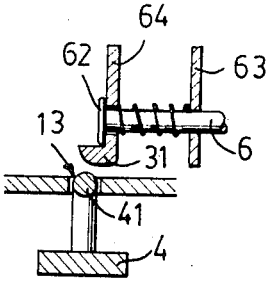
FIGS. 8A to 8C shows the sequence of the entry of an eyelet into the latch hole under locking state.
Figure 8B:
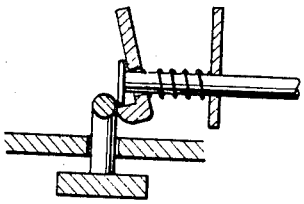
Figure 8C:
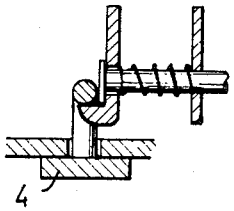

Since the latch member (31) and the pressing sheet (64) are not fixed to the end of shifting shaft, it is possible to press a latch flap into locking position without adjusting the number wheels to the correct code in advance. In FIG. 8A, the eyelet (41) of a flap (4) is pressed into a latch hole (13). The latch member (31) is in locking position. Since the latch member is not fixed on the shaft (6), it can be resiliently pushed aside (see FIG. 8B). After the eyelet (41) enters the latch hole (13) completely, the latch member resiliently engages with the eyelet (41).

Figure 9A:
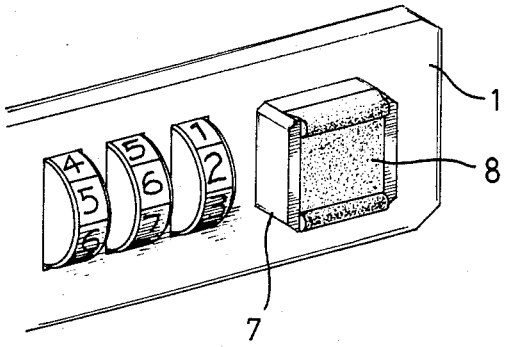
FIGS. 9A and 9B shows the two positions of the blocking switch in its mounting.
Figure 9B:
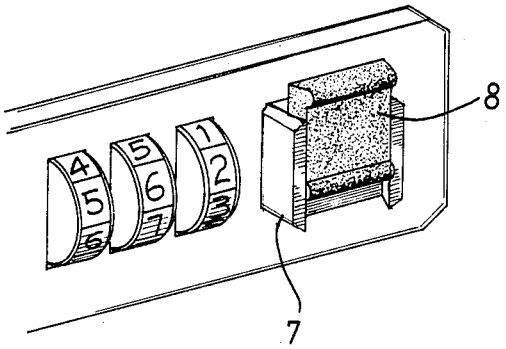

Finally we will describe the blocking mechanism. The knob (11) in the previous Figures (FIGS. 1, 3A to 3C, 4A to 4C, and 7A to 7C) is the same as in a conventional lock, and is not provided with blocking mechanism which prevents the entry of code-changing position. As stated before, the simplest way to prevent the entry into code-changing position is to put a stiff piece of plastic material between the knob and the number wheel to prevent its shift toward the code-changing position. But this has some disadvantages, which have been described hereinbefore. FIGS. 9A and 9B show a knob provided with such blocking mechanism in its mounting. The knob comprises two parts. A metallic knob frame (7), of which the function is the same as the simple knob (11) in the previous figures, and a plastic blocking switch (8), which serves as the blocking mechanism controlling the access to the code changing position. Practically the blocking switch (8) is retained in the knob frame (7) and can slide vertically in Y-axis direction between two stable positions in FIGS. 9A and 9B, namely blocking and unblocking positions. In the normal position of FIG. 9A it is impossible to shift the knob to code-changing position. If it is desired to change the code, use a thumb to shift the blocking switch (8) to the unblocking position in FIG. 9B. As stated before, the blocking switch (8) can be stably retained in the unblocking position in FIG. 9B, thus the user can directly shift the knob (here the term "knob" means the assembly of knob frame and the blocking switch) to its code-changing position without using his thumb to keep the blocking switch (8) in its unblocking position.

When the knob reaches its code changing position, switch the blocking switch (8) back to its blocking position, so the knob will be unable to return to its locking position. Therefore the user can comfortably re-adjust the code without using a hand to resist the resilient force to hold the knob in its code changing position. When the new code is set, push the blocking switching to its unblocking position, and let the knob resiliently resume its locking position. Then shift the blocking switch (8) back to the unblocking position.

It is easy to achieve the desired blocking and unblocking function using various devices. It is even easier to obtain the two stable retaining positions of the blocking switch. The following embodiment is only a feasible example out of many, and is not restrictive per se.

To achieve the blocking and unblocking function, the blocking switch (8) must be blocked by a specific portion of the lock which does not shift axially with the shifting shaft when the blocking switch (8) is in the blocking position. The blocking switch (8) is not blocked by this specific portion of the lock when it is in the unblocking position. Preferably this specific portion is a projection provided at housing (2).

Figure 10:
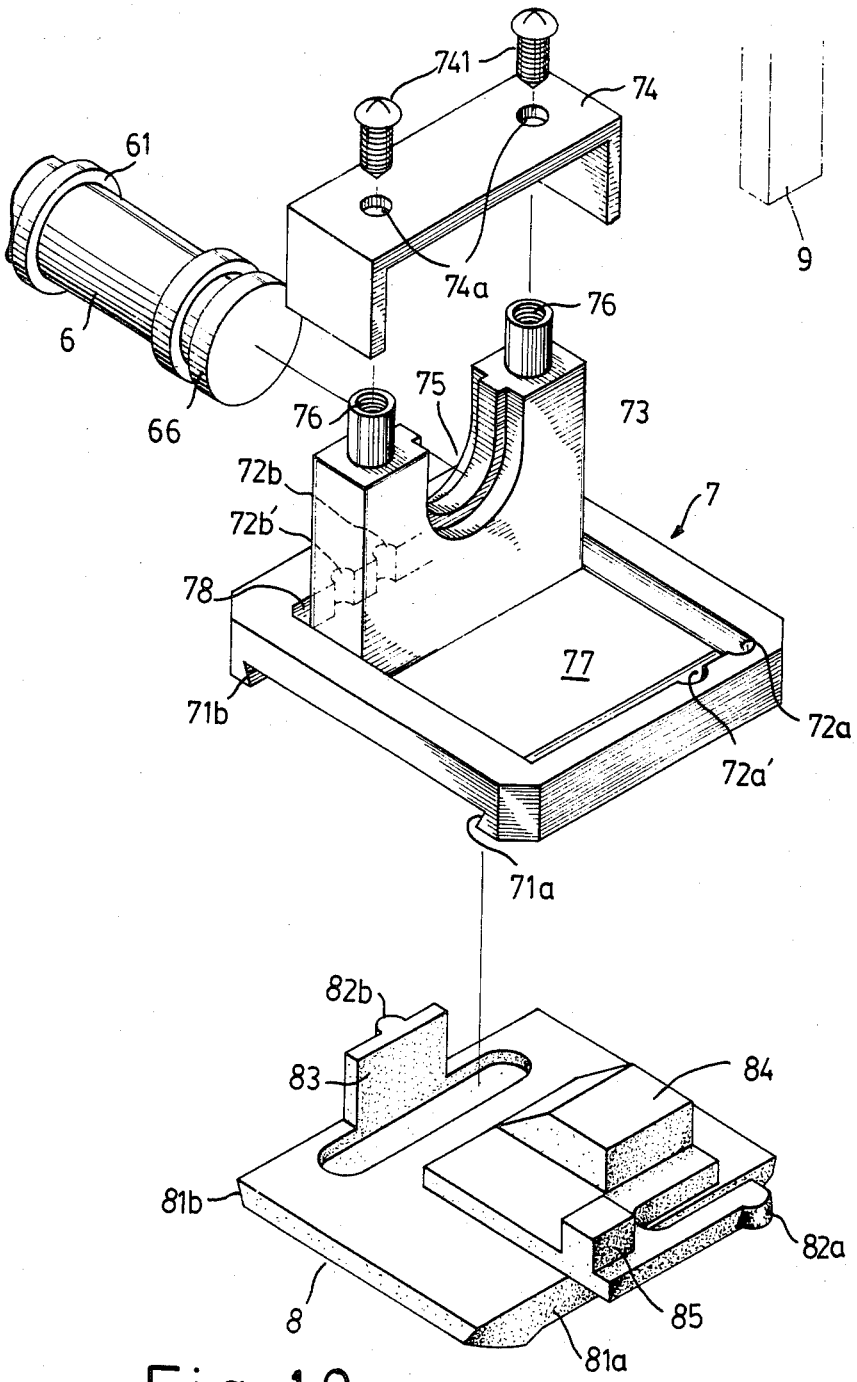
FIG. 10 is a perspective view of the knob frame and blocking switch and the way of their mounting on the shifting shaft.

Referring to FIG. 10, there are shown a metallic knob frame (7) and a plastic blocking switch (8). The lower part of the two wings of knob frame (7) forms two ridges (71*a*) (71*b*) whose inner sides are slightly sloped, thus allowing the two corresponding sides (81*a*) (81*b*) of the blocking switch (8) which are correspondingly sloped to be retained and slide therein. The upper part of the two wings of knob frame (7) are respectively provided with notches (72*a*) (72*a*') (72*b*) (72*b*'). Correspondingly the blocking switch (8) has two protuberances (82*a*) (82*b*). In blocking position, protuberances (82*a*) (82*b*) resiliently fit into notches (72*a*) (72*b*) by the inherent elasticity of plastic material, thus retaining the blocking switch (8) in blocking position (also see FIGS. 12A, 12D). On the other hand, in unblocking position, the protuberances (82*a*) (82*b*) fit into notches (72*a*') (72*b*') and retain the blocking switch (8) in unblocking position. (see FIGS. 12B, 12C).

With reference to FIG. 10, the knob frame (7) has a base (73), which together with a yoke (74), makes an equivalent to the knob base (112) in FIGS. 4A to 4C and FIGS. 7A to 7C. The base (73) has a recess (75) to receive the fixed end (66) of shifting shaft (6) which is then secured in place between the base (73) and yoke (74) by passing screws (741) through the hole (742) and the internally threaded sockets (76). Two slots (77) (78) are formed between the two wings and the base (73) of knob frame (7) to allow the "superstructures" (83) (84) and (85) of the blocking switch to be guided therein.

Finally we are going to discuss how to avoid careless entry into code changing position, and how to retain the knob in code-changing position without using an extra hand to do so.

Please refer to FIGS. 11A to 11D, and FIGS. 12A to 12D.

Figure 11A:
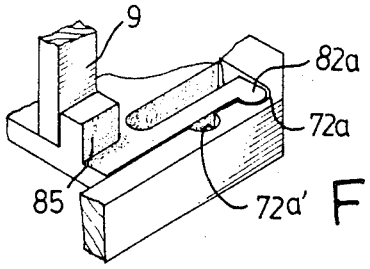
FIGS. 11A to 11D and FIGS. 12A to 12D show the relative position of the knob frame and blocking switch to the projection.
Figure 11B:
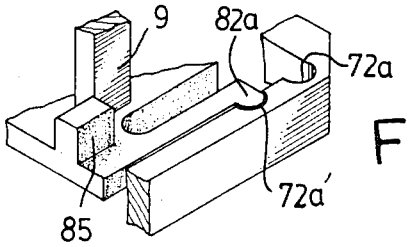
Figure 11C:
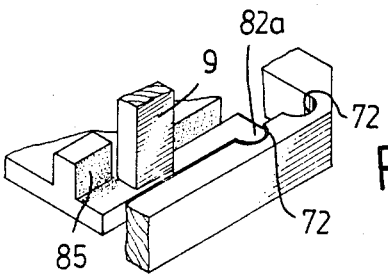
Figure 11D:
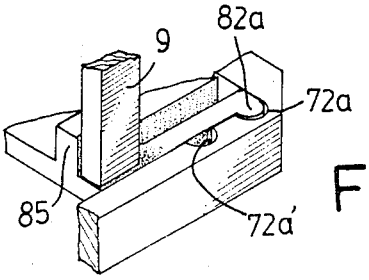
Figure 12A:
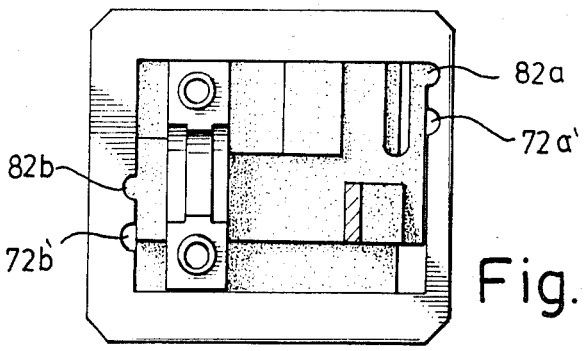
Figure 12B:
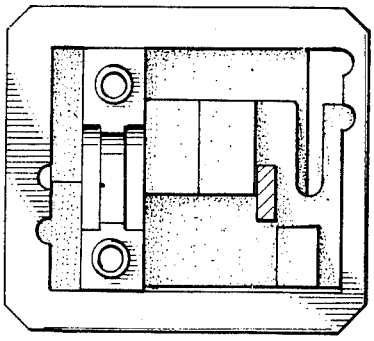
Figure 12C:
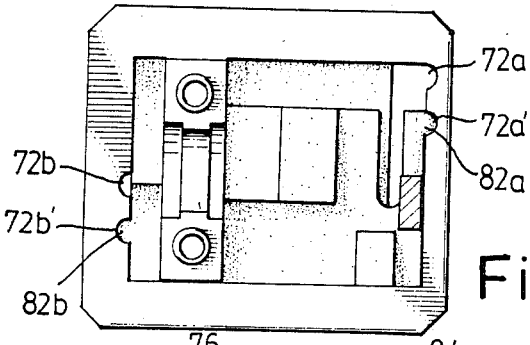
Figure 12D:
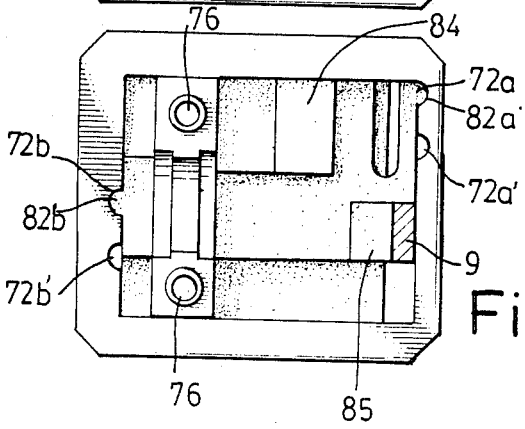
Figure 13:
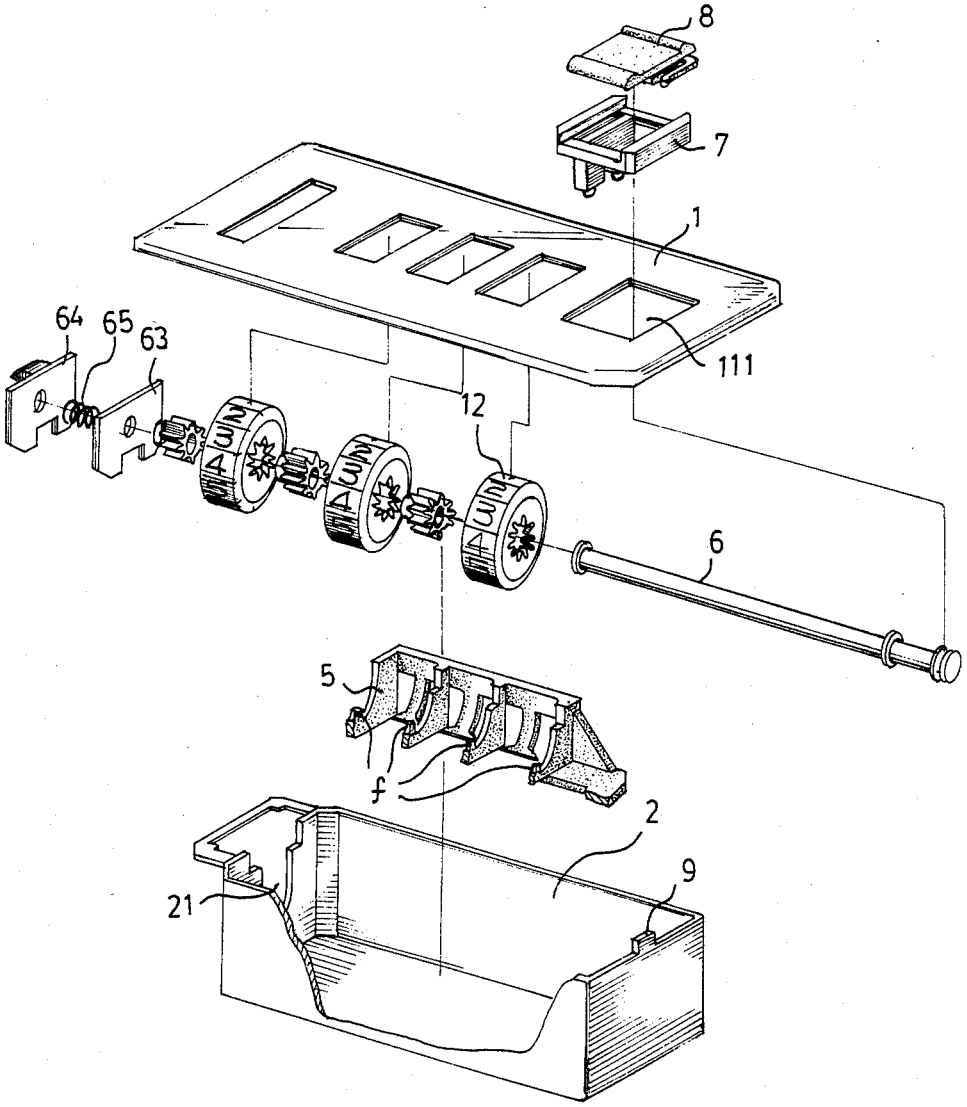
FIG. 13 is a fragmentary view showing the parts of a lock according to this invention.

A stop (85) is provided on the inner side of blocking switch (8). A projection (9) is formed at one end of the housing (2). It is formed at the "right end" in the direction of FIG. 2 so as to extend vertically to the blocking switch. In FIGS. 11A and 12A, the knob is normally in unlocking position and the blocking switch (8) is in its blocking position. Since the stop (85) is blocked by projection (9), the knob can only be shifted in an X-axis direction (i.e. toward unlocking position) and not in the opposite direction toward code-changing position. When the blocking switch (8) is shifted in the Y-axis direction and switched over to its unblocking position in FIGS. 11B and 12B, it is no longer blocked by projection (9) and can therefore be shifted in the X2 direction to its code-changing position in FIGS. 11C and 12C. Now the code can be changed by dialing the number wheels to the desired code. But the resilience of the spring (65) always urges the knob back to the locking position, so in this position one has to apply a force to resist the resilient force. Therefore we do not change the code in this position, but push the blocking switch into its blocking position. Now we are in the state of FIGS. 11D and 12D. Now the stop (85) is blocked by the projection (9), therefore it is impossible to directly shift the knob back to its locking position, and we can re-adjust the code comfortably without using an extra hand to resist the resumptive force of the spring. When the code is re-adjusted, reverse the procedure to shift the knob and the blocking switch from the position in 12D through 12C, 12B back to 12A. The other stop (84) serves to prevent the knob from going beyond its locking position when it returns from the position in FIG. 12C to the position in FIG. 12B. Here projection (9) is in contact with the stop (84), and prevents the knob from further shifting toward its opening position. Hence the user knows that the unlocking position is reached, and can switch the blocking switch back to its locking position. FIG. 13 is an exploded view of all elements of this invention.

We have now described all the functions and operations of this invention. However, the illustrative embodiment in the drawing is not the only way to achieve the object of this invention. Those skilled in the art will appreciate that various modifications can be made without departing from the spirit of this invention. For example, each inner wheel can have only a ward which corresponds to a slot corresponding to a definite number of a number wheel. In this case, the wheel retainer is not provided with projections to block the axial shift of the inner wheels. Likewise, the second and third object can also be achieved using equivalent mechanical means. Though the combination lock in the drawing is used to cooperate with a latch flap with an eyelet, it can also be used to cooperate with a hook of another type, without modifying the essential parts of this invention.

The lock in the illustrated embodiment in FIG. 1 is a right type. In other words it is provided at the right side of a suitcase. Since most of the elements are laterally symmetrical, they can be used for both right type and left type locks. The only elements which cannot be interchanged between a left type lock and a right type lock are the number wheels (12), the knob frame (7) and the blocking switch (8). (In the conventional locks, the number wheels and the knob are interchangeable between left type and right type.) The knob frame (7) and blocking switch (8) shown in FIGS. 10 to 12D are specific for a left type lock. In FIG. 13 they are specific for a right type lock.

I claim:

1. A combination lock for a hollow container such as a suitcase, luggage or the like, said hollow container having an upper part and a lower part, said lock being secured to the lower part of said container, the upper part of said container being provided with engaging means, said lock comprising locking means to lock said engaging means, shifting means for shifting said locking means between locking and unlocking positions, respectively corresponding to locking and releasing of said engaging means, a plurality of code means which only allow said shifting means to shift when adjusted to a specific position out of several predetermined positions, a plurality of corresponding adjusting means to adjust said code means, said code means being rotatably and axially immovably mounted on said shifting means and therefore shifting with said shifting means, said code means being in engagement with said adjusting means when said shifting means is in locking position and therefore driven to rotate with said adjusting means, said code means being disengageable from said adjusting means, said lock being further provided with resilient means which biases said shifting means from the unlocking position thereof toward the locking position thereof, said shifting means comprising a shifting shaft and a knob fixed on a first end of said shifting shaft, said locking means being mounted on a second end of said shifting shaft, said shifting means being shiftable among three positions, a locking position corresponding to said locking position of said locking means, an unlocking position corresponding to the unlocking position of said locking means, and a code-changing position, said code means being only disengaged from said adjusting means when said shifting means is in the code-changing position, said locking position of said shifting means being located between the unlocking position and the code-changing position, said resilient means being a single compression spring which also biases said shifting means toward the unlocking position when the shifting means is in the code-changing position, said shifting means having a first sheet and a second sheet slidably retained on the second end of said shifting shaft, said spring being retained on said shifting shaft between said first and second sheets, said locking means being fixed on the first sheet, said first sheet being closer to the second end of said shifting shaft, the structure of said lock being such that when said shifting means is shifted from its locking position toward its unlocking position, only said first sheet of the first and second sheets moves with said shifting shaft, and when said shifting means is shifted from locking position toward code-changing position, only said second sheet of the first and second sheets moves with a corresponding shifting shaft.

2. A combination lock according to claim 1, wherein said knob is provided with blocking means retained on said knob and movable in a direction perpendicular to the shifting direction of said shifting shaft between a blocking position and an unblocking position, said blocking means preventing the shifting of the said shifting means from the locking position to the code-changing position when said blocking means is in the blocking position.

3. A combination lock according to claim 2, wherein said knob is provided with retaining means to retain said blocking means in either the blocking position or the unblocking position.

* * * * *